United States Patent [19]

Holobaugh

[11] Patent Number: 4,493,469

[45] Date of Patent: Jan. 15, 1985

[54] HEIGHT ADJUSTMENT CONTROL ARRANGEMENT

[75] Inventor: Raymond E. Holobaugh, Tupelo, Miss.

[73] Assignee: Mohasco Corporation, Ansterdam, N.Y.

[21] Appl. No.: 459,044

[22] Filed: Jan. 19, 1983

[51] Int. Cl.[3] ..... F16M 11/00

[52] U.S. Cl. ..... 248/406.1; 108/147; 297/248

[58] Field of Search ..... 248/406, 405, 404, 416, 248/418, 408, 566; 108/147; 297/248

[56] References Cited

U.S. PATENT DOCUMENTS

| | | | |
|---|---|---|---|
| 1,242,109 | 10/1917 | Koken | 248/405 |
| 2,999,665 | 9/1961 | Ericson et al. | 248/405 |
| 3,386,697 | 6/1968 | Helms | 248/406 |
| 3,391,893 | 7/1968 | Doerner | 248/416 |
| 3,727,871 | 4/1973 | Harper | 248/406 |
| 3,910,544 | 10/1975 | Engstrom | 248/405 |
| 4,087,070 | 5/1978 | Hancock | 248/406 |
| 4,113,220 | 9/1978 | Godwin et al. | 248/566 |
| 4,394,001 | 7/1983 | Wisniewski | 248/406 |

FOREIGN PATENT DOCUMENTS

| | | | |
|---|---|---|---|
| 1078215 | 8/1967 | United Kingdom | 248/406 |

*Primary Examiner*—William H. Schultz
*Assistant Examiner*—Ramon O. Ramirez
*Attorney, Agent, or Firm*—Kirschstein, Kirschstein, Ottinger & Israel

[57] ABSTRACT

A height adjustment control arrangement for adjusting the height of a chair seat relative to a chair base in an office chair, includes a lower mounting assembly, an upper mounting assembly vertically displaceable relative to the lower mounting assembly, and a user-operated adjusting assembly operatively connected to the lower and upper mounting assemblies. The adjusting assembly includes an upright threaded shaft, a threaded nut on the shaft, a pull-up member on a lower side of the nut for pulling the latter upwardly, a push-down member on an upper side of the nut for pushing the latter downwardly, a keeper member movable between a locked and a released position in which displacement between the upper and lower mounting assemblies is respectively prevented and permitted, a release member for moving the keeper member between its locked and released positions, a restoring member for returning the release member to its initial position, and a counter-balance spring for urging the upper mounting assembly upwardly against the force of gravity.

20 Claims, 4 Drawing Figures

HEIGHT ADJUSTMENT CONTROL ARRANGEMENT

BACKGROUND OF THE INVENTION

1. Field of the Invention

The present invention generally relates to a longitudinal displacement adjustment control arrangement and, more particularly, to a height adjustment control arrangement, particularly for adjusting the height of a chair seat relative to a chair base for office chairs.

2. Description of the Prior Art

Height adjustment columns for adjusting the height of a chair seat relative to a chair base in an office chair are well known. In swivel office chairs having a main screw secured to the bottom of the chair seat and rotatably mounted on the chair base, it has been common practice to provide a nut assembly which can be manually rotated relative to the main screw for adjustment of the seat height. To adjust the seat height, it has been necessary for a user to get off the seat, kneel down below the seat, grasp the nut, and manually rotate the nut on the screw. The nut, or a handwheel associated therewith, can either be rotated about a horizontal or a vertical axis. In either case, many successive twisting motions are necessary to adjust the seat to the proper height. The user typically has to get on and get off the seat several times, and grasp the nut, and repeat the multiple motion rotary action. The manual adjustment of the chair seat of an office swivel chair of this type is disclosed in U.S. Pat. No. 4,087,070.

In further accordance with the prior art, gas-operated cylinder and piston chair control arrangements have been proposed, e.g. see U.S. Pat. No. 4,113,220. Such adjustable gas cylinder controls utilize valves to allow pressurized gas flow between compartments in a cylinder in which a piston is slidably received. Pressure seals are used to contain the pressurized gas in the cylinder. Such pressure seals are subject to frictional wear during adjustment, and tend to fail and leak gas over time. Once the pressurized gas loses pressure and escapes from the cylinder, the adjustable control arrangement is virtually completely useless until a complete overhaul is made, i.e. until the pressure seals are replaced, and the cylinder is recharged with pressurized gas.

SUMMARY OF THE INVENTION

Accordingly, it is the general object of this invention to overcome the aforementioned drawbacks of the prior art height adjustment control arrangements.

Another object of this invention is to easily adjust the seat height of an office chair without requiring that the user get off the seat, and without requiring that the user kneel down below the seat, and without requiring that the user grasp a rotary nut and/or a rotary handwheel associated therewith and perform a multiple motion twisting action.

Still another object of the present invention is to avoid the gas leak problem of prior art gas-operated height adjustment controls.

Yet a further object of this invention is to provide for a convenient seat height adjustment by actuating in a single motion an actuator that is within easy reach of a seated user.

Another object of this invention is to povide an adjustment control arrangement which can be used to adjust members that are not only spaced vertically apart of each other in elevation, but that can also be spaced horizontally apart of each other.

A further object of this invention is to provide an adjustment control arrangement that can be used to manually and conveniently adjust the distance between spaced-apart members of any type, and not only chair seats relative to chair bases.

Yet another object of this invention is to provide a height adjustment control arrangement, particularly for office chairs, which arrangement is inexpensive to manufacture, simple in construction, durable, but reliable in operation nevertheless.

FEATURES OF THE INVENTION

In keeping with these objects and others which will become apparent hereinafter, one feature of this invention resides, briefly stated, in a displacement adjustment control arrangement, which comprises a first mounting means, and a second mounting means displaceable in either direction along a longitudinal axis relative to the first mounting means in response to manual longitudinal displacement of the first and the second mounting means towards and away from each other. In a preferred embodiment, the longitudinal axis is vertical, and the control arrangment is operative for adjusting the height of one of the mounting means relative to the other of the mounting means. In a preferred application, a chair base of an office chair is operatively connected to the first or lower mounting means, and a chair seat of the office chair is operatively connected to the second or upper mounting means. Hence, the up-and-down displacement of the upper chair mounting means relative to the lower chair mounting means results in adjustment of the seat height.

The control arrangement comprises user-operated adjusting means operatively connected to the first and the second mounting means for manually adjusting the extent of the longitudinal displacement. The adjusting means or assembly includes a longitudinally-extending member having engaging portions, and an adjustment member having complementary engaging portions which engage the engaging portions and which mount the adjustment member on the longitudinally-extending member for movement along the same in response to the aforementioned longitudinal displacement. In the preferred embodiment, the longitudinally-extending member is an upright shaft having an externally threaded portion, and the adjustment member is an internally threaded nut member which threadedly engages the threaded shaft portion and rotates about the vertical axis for vertical axial movement along the threaded shaft portion.

The adjusting assembly also includes keeper means movable between a locked position and a released position. In the locked position, the keeper means lockingly engages the adjustment nut member and secures the same at one secured position on the longitudinally-extending member to thereby prevent the longitudinal displacement of the first and the second mounting means either towards or away from each other. In the released position, the keeper means is disengaged from locking engagement with the adjustment member, and the longitudinal displacement enables the adjustment member to be moved relative to the longitudinally-extending member to another secured position thereon. The other secured position is spaced longitudinally from the aforementioned one secured position.

In the preferred embodiment, pull-up means are provided on one of the mounting means for pulling the adjustment member upwardly in response to the longitudinal displacement of said one mounting means away from the other mounting means. Also, push-down means are provided on said one mounting means for pushing the adjustment member downwardly in response to the longitudinal displacement of said one mounting means towards the other mounting means. In the released position, The longitudinal displacement enables either the pull-up means, or the push-down means, or both, to move the adjustment member either up, or down, or in both directions, relative to the longitudinally-extending member.

The adjusting assembly further includes a single stroke, manually-actuatable release means in force-transmitting relationship with the keeper means, and operative for manually moving the same in a single motion from the locked to the released position. The release means includes a handle means located within easy reach of a user, preferably a seated user. The handle means is movable along a working stroke between a first and a second handle position which respectively corresponds to the locked and released positions of the keeper means.

The adjusting assembly yet further includes keeper restoring means operatively connected to the keeper means for moving the same from the released position to another locked position in which the keeper means lockingly engages the adjustment member and secures the same at said other secured position on the longitudinally-extending member. In the preferred embodiment, the keeper restoring means is a coil spring which is operatively connected to the handle means and which is operative, upon manual release of the handle means in its second handle position, for automatically moving the keeper means from its released position to its other locked position, and for concomitantly automatically moving the handle means from its second handle position to its first handle position.

In the event that the adjusting assembly is used to adjust height, counter-balance means are also provided as part of the adjusting assembly for upwardly urging the upper mounting means against the force of gravity during the manual height adjustment. In the preferred embodiment, the counter-balance means is a biasing spring whose spring constant is selected such that the spring counter-balances the weight of the seat components, but not the operating load, i.e. the body weight of the seated occupant.

In accordance with the invention, the user may manually adjust the extent of the longitudinal displacement to any desired amount by simply moving the single stroke release means with a single motion, and thereupon the simply either moving the first and the second mounting means either towards or away from each other so that the distance therebetween is the desired value. In the preferred embodiment, the handle is preferably located immediately below the seat so that the seated occupant need not get off the seat, or kneel underneath the seat, to operate the release means. The single motion action of the handle means obviates the multiple twisting actions required by the prior art nut and/or handwheel mechanisms. Of course, the avoidance of pressure seals and pressurized gas from the instant invention eliminates the prior art gas leak problem. The adjustment control arrangement of this invention is thus rendered durable and highly reliable in operation.

The novel features which are considered as characteristic of the invention are set forth in particular in the appended claims. The improved height adjustment control arrangement itself, however, both as to its structure and its mode of application, together with additional features and advantages thereof, will be best understood upon persual of the following detailed description of certain specific embodiments with reference to the accompanying drawing.

DETAILED DESCRIPTION OF THE PREFERRED EMBODIMENTS

Figure 1:
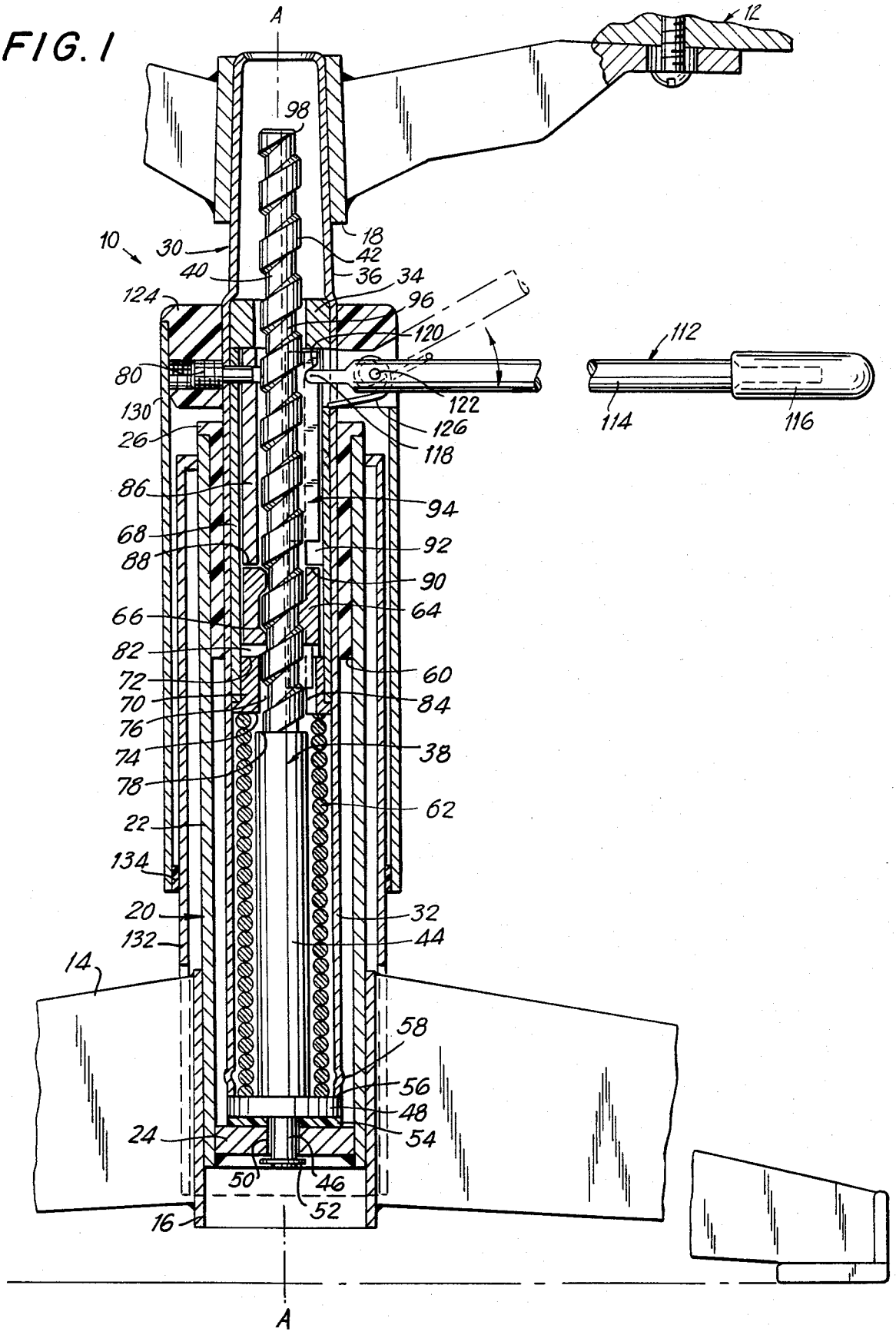
FIG. 1 is a vertical sectional view of a displacement adjustment control arrangement in accordance with this invention as used on an office chair shown in broken-away view.

Referring now to the drawing, and particularly to FIG. 1, reference numeral 10 generally identifies a displacement adjustment control arrangement. In order to simplify the description herein, the invention has been described as a height adjustment control arrangement or column of particular use for adjusting the height of a chair seat 12 relative to a chair base 14 of an office chair. However, it will be expressly understood that the control arrangement of this invention is not intended to be limited to vertical height adjustments in the up-and-down direction, nor to office chairs. The present invention can equally well be used to make horizontal adjustments in the to-and-fro, i.e. right-to-left, direction as well as linear adjustments at any inclined orientation. Furthermore, the adjustments can be made to any structural member which is desired to be spaced apart at a variably selected distance from any other structural member. Office chairs represent a particularly desirable application, but the control arrangement of this invention can equally well be used in many kinds of adjustment-type applications, such as umbrellas, adjustable ladders, adjustable furniture, adjustable canes, lowerable ceiling fans, adjustable tools, etc.

The height adjustment column 10 comprises a first or lower mounting means 20 that is operatively connected to the chair base 14, and a second or upper mounting means 30 that is operatively connected to the chair seat 12. The upper mounting means 30 is displaceable relative to the lower mounting means 20 in either longitudinal direction along a vertical axis A—A in response to manual axial displacement of the upper mounting means either towards (down), or away from (up), or in both directions relative to, the lower mounting means.

The lower mounting means 20 comprises an axially-extending elongated tubular body 22, a base plate 24 at the lower end of the body 22, and a tubular flanged bushing 26 at the upper end of the body 22. The body 22 and base plate 24 are preferably made of metal, and are welded together to form a rigid, integral construction, although they could be made of a one-piece construction. The bushing 26 is preferably made of an anti-friction material, such as plastic or an oilite-based metal, and is press-fitted into the upper open end of the body portion 22. The lower end of the body 22 is press-fitted into the interior of a generally conically-shaped tubular collar 16 to which a plurality of base support legs 14 are welded. The support legs 14 are equiangularly spaced about the vertical axis in conventional manner, and provide a stable support for the chair.

The upper mounting means 30 is mounted on the lower mounting means 20 for up-and-down axial movement, as well as for turning movement about the vertical axis. The upper mounting means 30 comprises an axially-extending elongated tubular sleeve 32 mounted in sliding telescoping relationship with the interior passage of the bushing 26, and a guide ring 34 tightly mounted within the interior passage of the sleeve 32 adjacent an upper neck region 36 thereof. The sleeve 32 and the guide ring 34 are preferably made of metal, and are press-fitted together to form a rigid, integral construction, although they could be made of a one-piece construction. The neck region 36 is press-fitted into the interior of a generally cylindrically-shaped tubular mounting collar 18 to which the seat 12 is fixedly secured in a conventional manner in order to provide a stable support for the chair seat.

Also mounted on the upper mounting means 30 is a user-operated adjusting means operatively connected between the upper mounting means 30 and the lower mounting means 20, and operative for manually adjusting the extent of the vertical displacement therebetween. The adjusting means comprises an axially-extending upright shaft member 38 having an upper threaded shaft portion 40 formed with an exterior spiral thread 42, a central cylindrical shaft portion 44, a lower cylindrical pivot pin portion 46, and an abutment flange portion 48 located intermediate the central shaft portion 44 and the pivot pin portion 46. The pivot pin portion 46 is received with a slight clearance within a central passage 50 extending axially through the base plate 24. The pivot pin portion 46 projects slightly past the passage 50, and a snap ring or nut 52 is secured to the projecting lower end of the pivot pin portion to prevent the latter from being axially withdrawn from the passage 50. A pivot bearing washer 54, preferably made of an anti-friction material such as teflon or delron, is interposed between the upper side of the base plate 24 and the lower side of the abutment flange 48 in order to permit the shaft member 38, i.e. the upper mounting means 30, to rotate in a reduced friction manner in either circumferential direction about the vertical axis relative to the base plate 24, i.e. the lower mounting means 20.

As noted previously, the upper mounting means 30 is displaceable vertically relative to the lower mounting means 20. In FIG. 1, the upper mounting means 30 is shown in its fully down or collapsed end-limiting position in which the lower axial end face 56 of the sleeve 32 abuts against the upper side of the abutment flange 48.

As the upper mounting means 30 is displaced upwardly from the FIG. 1 position, the lower axial end face 56 of the sleeve 32 will no longer abut against the abutment flange 48, but will be axially spaced therefrom. An annular arresting ridge 58 is located at the exterior of the sleeve 32. The arresting ridge 58 projects radially outwardly of the sleeve 32 for a distance which is preferably, but not necessarily, short of the inner circumferential wall of the tubular body 22. In the fully up or extended end-limiting position of the upper mounting means 30, the projecting ridge 58 directly abuts against the lower axial end face 60 of the bushing 26. The projecting ridge 58 serves as a limit means for preventing the upper mounting means 30 from being displaced beyond its fully up or extended position. The user may adjust the height of the chair seat to the fully collapsed position, or to the fully extended position, or to any one of a plurality of intermediate positions between the fully collapsed and the fully extended positions.

The adjusting means also comprises an adjustment member or nut 64 having complementary engaging portions, i.e. an interior thread 66, which engage the exterior thread 42 of the threaded shaft portion 40. In a preferred embodiment, the pitch of the exterior and complementary interior thread is on the order of two threads per inch in order to permit the nut 64 to rotate easily about the threaded shaft portion 40 and to move axially along the same in response to the axial displacement of the upper mounting means relative to the lower mounting means.

The adjusting means also comprises pull-up means 68,70 fixedly mounted by set screw 80 on the upper mounting means 30, and operative for pulling the nut 64 upwardly when the upper mounting means 30 is pulled upwardly by the user. The pull-up means includes a cylindrical hollow member 68 and a flanged lower bushing 70 press-fitted into the lower open end of the hollow member 68. The hollow member 68 and the flanged bushing 70 are preferably made of metal, and are press-fitted together to form a rigid, unitary construction, although they could be formed of a one-piece construction. The flanged bushing 70 has an upper axial end face 72, a lower axial end face 74, and a central passageway 76 extending between the end faces 72,74. The central passageway 76 is sized so as to permit the threaded shaft portion 40 to pass therethrough with clearance, but so as to prevent the central shaft portion 44 from entering therein. The shoulder 78 formed between the threaded shaft portion 40 and the central shaft portion 44 is located below the bushing end face 74 even in the fully collapsed position, thereby preventing entry of the central shaft portion 44 into the passageway 76. During the pull-up motion, the upper end face 72 of the lower bushing 70 operatively engages the lower axial end face 82 of the nut 64 in force-transmitting relationship to effect the pulling-up motion, as described below. As also described below, an axial slot 84 is formed in the passageway 76.

The adjusting means also comprises push-down means 86 fixedly mounted by set screw 80 on the upper mounting means 30, and operative for pushing the nut 64 downwardly when the upper mounting means 30 is pushed downwardly. The push-down means constitutes a C-shaped upper bushing 86 whose lower end face 88 operatively engages the upper axial end face 90 of the nut 64 in force-transmitting relationship therewith to effect the pushing-down motion, as described below. The slitted area in the C-shaped bushing 86 constitutes an axial slot 92 which cooperates with the aforementioned axial slot 84, as described below.

Figure 4:
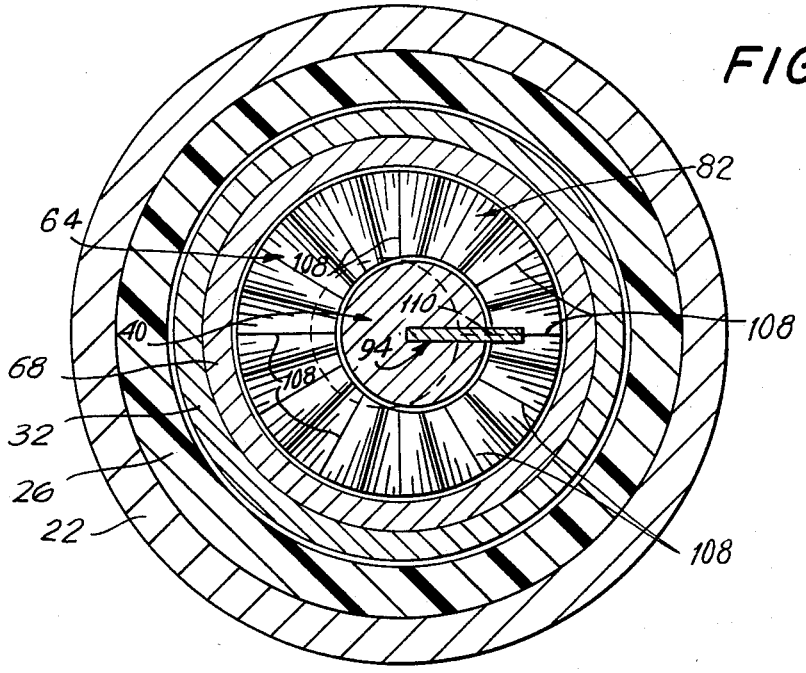
FIG. 4 is a cross-sectional view taken on line 4—4 of FIG. 2.

The adjusting means further comprises keeper means 94 slidably movable along the aforementioned axial slot 92 formed in the upper bushing 86, the aforementioned axial slot 84 formed in the lower bushing 70, and an axially-extending keyway slot 96 formed in and along the length of the threaded shaft portion 40 from its free upper end 98 to the shoulder 78. As best seen in FIG. 4, the keeper means 94 is constituted by a planar keeper member 94 having a narrow rectangular cross-section. The cross-section of the slots 92,96 and 84 each has a corresponding narrow rectangular cross-section in order to receive the keeper member 94 in a tight sliding fit relationship.

Figure 2:
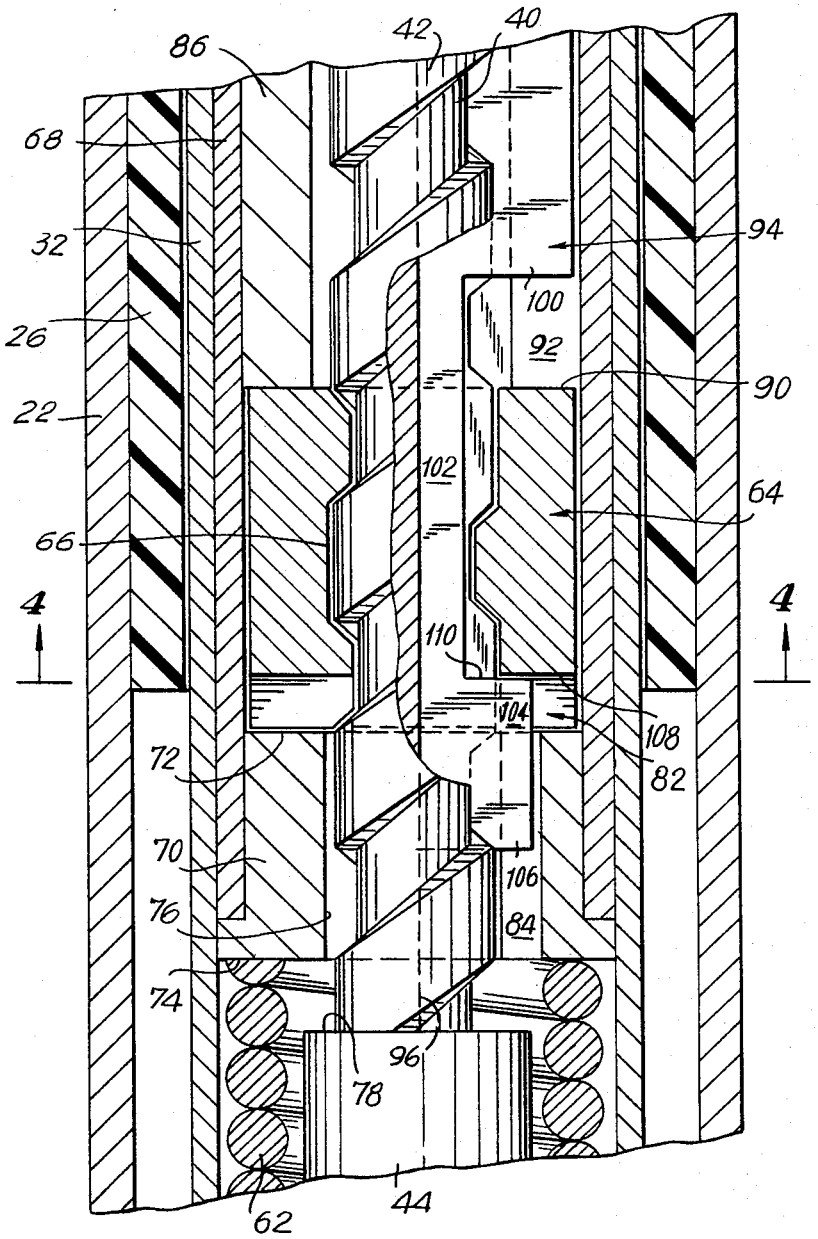
FIG. 2 is a broken-away, enlarged, vertical sectional view of a detail of FIG. 1 shown in the locked mode of operation.

As best shown in FIG. 2, the keeper member 94 has an upper wide keying portion 100 that is slidably received in the axial slot 92 of the upper bushing 86, a narrow bypass portion 102 that is slidably received in the keyway slot 96 formed between the threaded shaft portion 40 and the nut 64, a tang portion 104 that lockingly engages the lower end region 82 of the nut 64, and a lower keying portion 106 that is slidably received in the axial slot 84 of the lower bushing 70. The keeper member 94 also serves to prevent relative rotation among the shaft member 38, the upper bushing 86 and the lower bushing 70.

Figure 3:
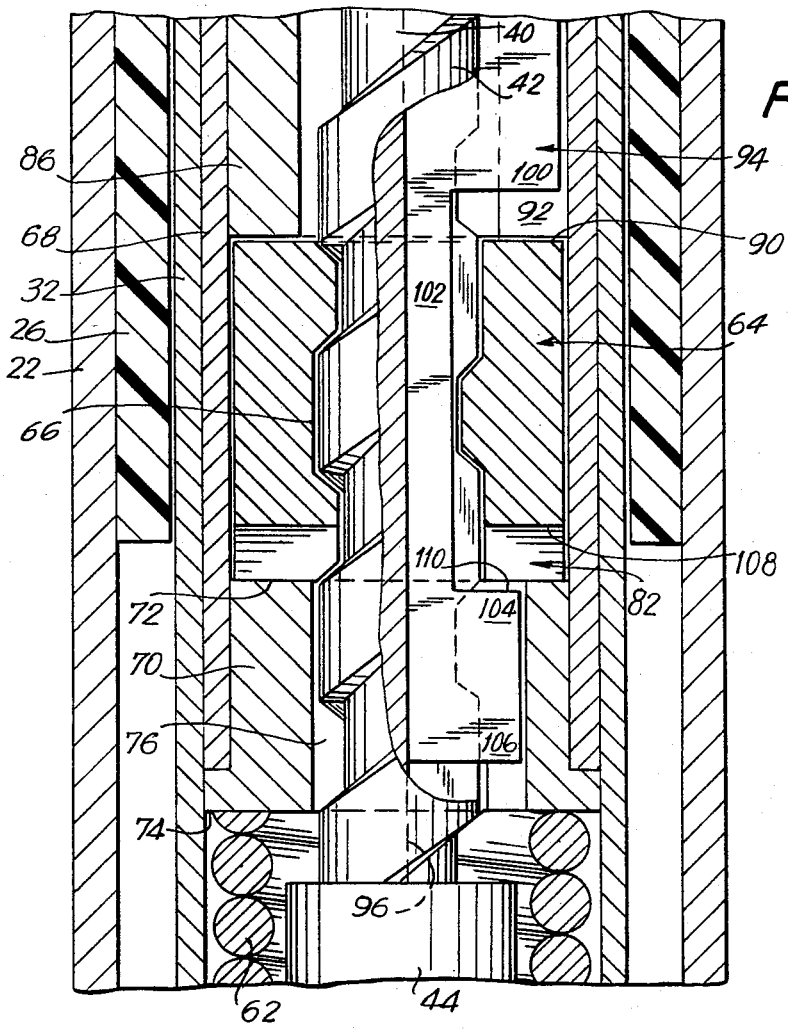
FIG. 3 is analogous to FIG. 2, but in the released mode of operation.

The keeper member 94 is movable between a locked position, as shown in FIG. 2, and a released position, as shown in FIG. 3. In the locked position, the tang portion 104 of the keeper member 94 lockingly engages the lower end region 82 of the nut 64 in order to secure the same at a secured position on the threaded shaft portion 40. In the locked position, the upper mounting means 30 is prevented from being manually displaced, either upwardly or downwardly, by the user. As best shown in FIG. 4, the lower end region 82 of the nut 64 is formed with a plurality of radially-extending notches or V-shaped grooves 108 equiangularly arranged about the vertical axis in a spoke-like pattern. The reception of the tang portion 104 in any groove 108 defines a selected one of a plurality of locked positions. The more grooves 108 that are formed in the underside of the nut 64, the more locked positions will be available, and the more continuous will be the height adjustment. The tang portion 104 preferably has a tapered sharp knife edge 110 to facilitate entry and exit of the tang portion into any groove 108.

In the released position shown in FIG. 3, the tang portion 104 of the keeper member 94 has been moved downwardly and disengaged from locking engagement with the grooved nut 64. The downward movement of the keeper member 94 did not move the nut 64, because the bypass portion 102 passed right through the interior of the nut 64 without transmitting any force to the same. The knife edge 110 is moved to a position at, or preferably slightly below, the upper end face 72 of the lower bushing 70 to free the nut 64 to turn relative to the threaded shaft portion 40. Inasmuch as the nut 64 is no longer restrained from turning on the threaded shaft portion, the user, by pulling the upper mounting means 30 upwardly, enables the pull-up means 68,70 which is fixed to the upper mounting means, to be operative to engage the lower end region of the nut and to pull the latter upwardly by causing the nut to self-rotate about the threaded shaft portion. Similarly, by having the user push the upper mounting means 30 downwardly, the push-down means 86, which is also fixed to the upper mounting means, is operative to engage the upper end region of the nut and to push the latter downwardly by causing the nut to self-rotate about the threaded shaft portion. The pitch of the threads on the threaded shaft portion 40 and the nut 64 are selected to cause the nut to self-rotate without an excessive amount of pulling and/or pushing forces being required. The nut is preferably constituted of a low coefficient of friction material, such as an oil-impregnated sintered bronze material. The operation of the pull-up and/or push-down means moves the nut to any desired position along the threaded shaft portion 40, at which position the nut 64 will again be secured by the keeper means.

The adjustment means still further comprises single stroke, manually-actuatable release means 112 in force-transmitting operative engagement with the keeper means 94 for manually moving the same in a single motion from any locked position to the released position. The release means 112 includes handle means having an elongated lever 114 that extends transversely away from the vertical axis, a hand grip portion 116 at the outer end of the lever 114, and an actuating finger 118 at the inner end of the lever and receivable in force-transmitting relationship with a cutout 120 formed in the keeper member 94. The handle means is movable from a first handle position, as illustrated in solid lines, which corresponds to the normally locked position of the keeper means, along a working stroke, to a second handle position, which is illustrated in phantom lines, which corresponds to the released position of the keeper means. The hand grip portion 116 is preferably located within easy hand reach of a seated user, i.e. just below the seat 12, so that the seated user can grasp the hand grip portion 116 and pull up on the handle lever 114 to effect the release and to enable the chair seat height to be adjusted as desired. It should be noted that the pulling up action on the handle means to effect the release is simpler for most seated users to perform, as opposed to a pushing down action on the handle means.

The handle lever 114 is pivotally mounted at pivot pin 122 on a handle mounting member 124, preferably constituted of plastic or metal material. The handle mounting member 124 is fixedly mounted for joint movement with the upper mounting means 30 by the set screw 80. Hence, the handle means 112 jointly moves with the upper mounting means, and is always located in the preferred accessible location just below the seat 12 for subsequent adjustment, if necessary.

A keeper restoring means 126 is operatively connected to the keeper member 94 and the handle means 112 and is operative, upon manual release of the hand grip portion 116 in its second handle position, for automatically moving the keeper member from the released position to any other locked position so that the nut can be secured in any other desired secured position. Preferably, the keeper restoring means 126 is a coil spring which is mounted on the pivot pin 122, and which has one end in force-transmitting engagement with the handle lever 114, and its other end in force-transmitting engagement with the upper mounting means. The keeper restoring means thus also serves to automatically return the handle means to its first handle position.

A counter-balance means, preferably an elongated compression coiled spring 62, is operative for upwardly urging the upper mounting means 30 against the force of gravity during the manual height adjustment. The spring 62 is coiled around the upright shaft 38. The lower end of the counter-balance spring 62 is constantly biased against the abutment flange 48. The upper end of the counter-balance spring 62 is constantly biased against the lower end face 74 of the lower bushing 70. The compression spring 62 has a spring constant selected to counter-balance the weight of the chair seat and/or backrest, if any, but is not intended to counter-balance the body weight of a seated occupant. The spring 62 serves to assist the user, particularly one of weak muscular strength, to elevate the chair seat by supporting the chair seat weight. Certain office chairs, particularly high-backed executive chairs, can weigh a great deal and, in this case, the counter-balance spring 62 is of great advantage. In the unlikely event that the counter-balance spring should fail with prolonged usage by splitting one of its coils, the adjusting control arrangment will still function, unlike the aforementioned prior art gas-operated chairs, wherein a gas leak rendered the chair virtually useless.

For aesthetic purposes, a decorative cover 130 is mounted on the exterior of the handle mounting member 124 to overlie and conceal the upper part of the adjusting means. Another decorative cover 132 is likewise mounted on the exterior of the lower mounting means to overlie and conceal the lower part of the adjusting means. The covers 130,132 are preferably mounted in telescoping relationship with each other, and have an anti-friction bearing ring 134 therebetween in order to resist friction.

In operation, as noted above, the upper mounting means 30 and the chair seat 12 connected thereto are turnable about the vertical axis relative to the lower mounting means 20 and the chair base 14 connected thereto. The set screw 80 fixedly secures the hollow member 68, the lower bushing 70 and the upper bushing 86 to the sleeve 32. The keeper means 94 secures lower bushing 70 and the upright shaft 38. The set screw 80 and the keeper means 94 serve to keep all the components mounted on the upper mounting means, together with the counter-balance spring 62 which is captured between the abutment flange 48 and the lower bushing 70, to rotate as a unit relative to the lower mounting means whenever any turning or swiveling forces are applied to the chair seat 12.

Once the nut 64 is released by operation of the release means 112, the user may advantageously pull up on the seat 12 to cause the pull-up means 68,70 to engage the underside of the released nut and pull the same upwardly to the desired extent. The user may also advantageously push down on the seat 12 to cause the push-down means 86 to engage the topside of the released nut and push the same downardly to the desired extent. Once the desired chair seat height is obtained, the release of the hand grip portion 116 causes the spring 126 to return the handle means to its first handle position, and also to return the keeper means to the desired locked position. Subsequent adjustments can be made by repeating the steps described above.

It will be understood that each of the elements described above, or two or more together, may also find a useful application in other types of arrangements differing from the type described above.

While the invention has been illustrated and described as embodied in a height adjustment control arrangement, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

What is claimed as new and desired to be protected by Letters Patent is set forth in the appended claims.

I claim:

1. A displacement adjustment control arrangement, comprising:

(a) a first mounting means, and a second mounting means displaceable in either direction along a longitudinal axis relative to the first mounting means in response to manual longitudinal displacement of the first and the second mounting means towards and away from each other; and (b) user-operated adjusting means operatively connected to the first and the second mounting means for manually adjusting the extent of the longitudinal displacement, including (1) a longitudinally-extending member having engaging portions, (2) an adjustment member having complementary engaging portions which engage the engaging portions and mount the adjustment member on the longitudinally-extending member for movement along the same in response to the longitudinal displacement, (3) keeper means movable between a locked position in which the keeper means lockingly engages the adjustment member and secures the same at one secured position on the longitudinally-extending member to thereby prevent the longitudinal displacement, and a released position in which the keeper means is disengaged from locking engagement with the adjustment member and enables the longitudinal displacement to move the adjustment member relative to the longitudinally-extending member to another secured position thereon that is spaced longitudinally from the one secured position, (4) single stroke, manually-actuatable release means in force-transmitting relationship with the keeper means for manually moving the same in a single motion from the locked position to the released position, said release means including a handle means located within easy reach of a user, and (5) keeper restoring means operatively connected to the keeper means for moving the same from the released position to another locked position in which the keeper means lockingly engages the adjustment member and secures the same at said other secured position on the longitudinally-extending member, whereby the user may manually adjust the extent of the longitudinal displacement to any desired amount.

2. The control arrangement as defined in claim 1, wherein each of the first and the second mounting means has longitudinally-extending telescoping portions mounted in mutual telescoping relationship, and wherein each of the first and the second mounting means has vertically spaced-apart mounting portions.

3. The control arrangement as defined in claim 1, wherein the first and the second mounting means are also mounted on each other for turning movement in either circumferential direction about the longitudinal axis.

4. The control arrangement as defined in claim 1, wherein the first and the second mounting means are longitudinally displaceable along a vertical axis; and further comprising counter-balance means in operative engagement with one of the mounting means for upwardly urging the same against the force of gravity.

5. The control arrangement as defined in claim 1, wherein the first and the second mounting means are longitudinally displaceable along a vertical axis; and wherein one of the mounting means includes pull-up means for pulling the adjustment member upwardly in response to longitudinal displacement of said one mounting means away from the other mounting means, and also includes push-down means for pushing the adjustment member downwardly in response to longitudinal displacement of said one mounting means towards said other mounting means.

6. The control arrangement as defined in claim 5, wherein the adjustment member has upper and lower end regions, and wherein the pull-up means includes a pull-up member for operatively engaging the lower end region during the pulling movement, and wherein the push-down means includes a push-down member for operatively engaging the upper end region during the pushing movement.

7. The control arrangement as defined in claim 1, wherein the longitudinally-extending member includes an upright shaft with threaded engaging portions, and wherein the adjustment member constitutes a nut member with complementary threaded engaging portions, and wherein the nut member is turnable about the longitudinal axis on the upright shaft during the longitudinal displacement.

8. The control arrangement as defined in claim 7, wherein the pitch of the threaded engaging portions is on the order of two threads per inch.

9. The control arrangement as defined in claim 1, wherein the adjustment member has upper and lower end regions, and wherein the keeper means extends longitudinally from the upper to the lower end regions of the adjustment member through a clearance formed between the longitudinally-extending member and the adjustment member, said keeper means lockingly engaging the lower end region of the adjustment member in the locked position.

10. The control arrangement as defined in claim 9, wherein the clearance constitutes a longitudinal keyway slot formed in the longitudinally-extending member, said keeper means being slidably received in the keyway slot.

11. The control arrangement as defined in claim 1, wherein the handle means extends transversely of the longitudinal axis, and is movable in a vertical plane for moving the keeper means from the locked position to the released position.

12. The control arrangement as defined in claim 1, wherein the keeper means lockingly engages the adjustment member in any selected one of a plurality of locked positions.

13. The control arrangement as defined in claim 12, wherein the keeper means includes a tang portion, and wherein the adjustment member has a plurality of transversely-extending grooves in each of which the tank portion may be received to define each of the locked positions.

14. The control arrangement as defined in claim 13, wherein the release means moves the keeper means along a vertical axis, and wherein the grooves on the adjustment member are formed in the lower end region of the same and extend in a radial direction.

15. The control arrangement as defined in claim 1; and further comprising limit means for preventing the first and the second mounting means from being displaced beyond a predetermined extent.

16. The control arrangement as defined in claim 1, wherein each of the first and the second mounting means includes decorative tubular covers mounted in mutual telescoping engagement.

17. A height adjustment control arrangement, particularly for adjusting the height of a chair seat relative to a chair base, comprising:

(a) a lower mounting means, and an upper mounting means displaceable longitudinally in either direction along a vertical axis relative to the lower mounting means in response to manual longitudinal displacement of the upper and the lower mounting means towards and away from each other;

(b) user-operated adjusting means operatively connected to the upper and the lower mounting means for manually adjusting the vertical extent of the longitudinal displacement, including (1) a longitudinally-extending upright shaft member having engaging portions, (2) an adjustment member having complementary engaging portions which engage the engaging portions and mount the adjustment member on the shaft member for longitudinal movement therealong in response to the longitudinal displacement, (3) pull-up means on one of the mounting means for pulling the adjustment member upwardly in response to longitudinal displacement of said one mounting means away from the other mounting means, (4) push-down means on said one mounting means for pushing the adjustment member downwardly in response to longitudinal displacement of said one mounting means towards said other mounting means, (5) keeper means movable between a locked position in which the keeper means lockingly engages the adjustment member and secures the same at one secured position on the shaft member to thereby prevent the longitudinal displacement, and a released position in which the keeper means is disengaged from locking engagement with the adjustment member and enables at least one of said pull-up means and said push-down means to move the adjustment member relative to the shaft member to another secured position thereon that is axially spaced from said one secured position, (6) single stroke, manually-actuatable release means in force-transmitting relationship with the keeper means for manually moving the same in a single motion from the locked to the released position, said release means including a handle means located within easy reach of a user and movable from a first to a second handle position respectively corresponding to the locked and released positions of the keeper means, and (7) keeper restoring means operatively connected to the keeper means and the handle means and operative, upon manual release of the handle means in its second handle position, for automatically moving the keeper means from the released position to another locked position in which the keeper means lockingly engages the adjustment member and secures the same at said other secured position on the shaft member; and (c) counter-balance means in operative engagement with the upper mounting means for upwardly urging the latter against the force of gravity during the manual height adjustment.

18. The height adjustment control arrangement as defined in claim 17, wherein an axially-extending keyway slot is formed along the shaft member, and wherein the keeper means is slidably mounted in the keyway slot.

19. The height adjustment control arrangement as defined in claim 18, wherein the adjustment member has a lower end portion, and wherein the keeper means has an axially-extending keeper portion slidably received in the keyway slot, and a tang portion lockingly engageable with the lower end portion of the adjustment member.

20. The height adjustment control arrangement as defined in claim 19, wherein the lower end portion of the adjustment member is formed with a plurality of radially-extending grooves for receiving the tang portion in any one of a plurality of locked positions.

* * * * *